US008903287B2

(12) United States Patent
Naruge et al.

(10) Patent No.: US 8,903,287 B2
(45) Date of Patent: Dec. 2, 2014

(54) IMAGE FORMING APPARATUS

(71) Applicant: Canon Kabushiki Kaisha, Tokyo (JP)

(72) Inventors: Yasutaka Naruge, Yokohama (JP); Hideyuki Miyamoto, Mishima (JP); Atsushi Sano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/973,765

(22) Filed: Aug. 22, 2013

(65) Prior Publication Data

US 2014/0056624 A1 Feb. 27, 2014

(30) Foreign Application Priority Data

Aug. 27, 2012 (JP) ..... 2012-186540

(51) Int. Cl.

| | |
|---|---|
| ***G03G 15/01*** | (2006.01) |
| ***G03G 15/043*** | (2006.01) |
| ***G03G 15/00*** | (2006.01) |

(52) U.S. Cl.

CPC ..... *G03G 15/043* (2013.01); *G03G 15/5037* (2013.01)

USPC ..... 399/301; 369/48; 369/51; 369/118

(58) Field of Classification Search

USPC ..... 399/38, 46, 48, 49, 51, 107, 110, 118, 399/297–301

See application file for complete search history.

(56) References Cited

U.S. PATENT DOCUMENTS 7,418,234 B2 * 8/2008 Murakami et al. ..... 399/401

FOREIGN PATENT DOCUMENTS

| | | | |
|---|---|---|---|
| JP | 7-234612 | A | 9/1995 |
| JP | 10-039571 | A | 2/1998 |
| JP | 2012-032777 | A | 2/2012 |

* cited by examiner

*Primary Examiner* — Hoan Tran

(74) *Attorney, Agent, or Firm* — Canon U.S.A., Inc. IP Division

(57) ABSTRACT

A light irradiation unit forms an electrostatic latent image pattern on a photosensitive member by irradiating the photosensitive member and a shielding unit with light. A detection unit detects, in a rotation direction of the photosensitive member, timing at which a surface potential of the photosensitive member changes depending on displacement of the electrostatic latent image pattern in an axial direction of the photosensitive member.

18 Claims, 17 Drawing Sheets

| L2s | L2e | L2s | L2e | SCANNING LINE | CORRECTION |
|---|---|---|---|---|---|
| +Td | +Td | RIGHT | LEFT | EXPANSION | INCREASE IMAGE CLOCK FREQUENCY |
| +Td | -Td | RIGHT | RIGHT | MISREGISTRATION TO THE RIGHT | MAKE WRITE START TIMING LATER |
| -Td | +Td | LEFT | LEFT | MISREGISTRATION TO THE LEFT | MAKE WRITE START TIMING EARLIER |
| -Td | -Td | LEFT | RIGHT | CONTRACTION | DECREASE IMAGE CLOCK FREQUENCY |

IMAGE FORMING APPARATUS

BACKGROUND OF THE INVENTION

1. Field of the Invention

The present invention relates to an image forming apparatus using an electrophotographic method.

2. Description of the Related Art

In an image forming apparatus using an electrophotographic method, a scanner unit irradiates a photosensitive member with light to form an electrostatic latent image thereon. After the formed electrostatic latent image is developed with toner, the developed image is transferred onto the recording medium. In this way, an image is formed on a recording medium. With this type of apparatus, if images are formed continuously over a long time, the temperature inside the apparatus is increased. Consequently, image misregistration may be caused. Such image misregistration signifies shifting of the light, which is radiated from the scanner unit to the photosensitive member, from an appropriate irradiation position. A primary cause of the image misregistration is a change of characteristics of a lens or the like included in the scanner unit by an increase of the temperature. In addition, other causes of the image misregistration include mechanical installation errors of the photosensitive member and the scanner unit and eccentricity of the photosensitive member or a gear for driving the photosensitive member. Various measures for correcting the image misregistration caused by these reasons have been demanded.

In addition, if a single photosensitive member is used as described above, misregistration of an image formation position is simply caused. However, in the case of a color image forming apparatus that forms an image by using a plurality of photosensitive members, the image misregistration results in color misregistration. Namely, for example, when different colors of images formed on the respective photosensitive members are sequentially superimposed and transferred onto an intermediate transfer member, if the transfer position of an image of a certain color is misregistered relative to the transfer positions of the images of the other colors, color misregistration is caused in the superimposed color image.

The image misregistration can be caused in a sub-scanning direction, which is the direction in which the photosensitive member is rotated, and in a main-scanning direction, which is the direction in which the light radiated from the scanner unit scans the photosensitive member. For example, if the image misregistration in the main-scanning direction is caused, the image is tilted in the main-scanning direction or the length of the image is changed in the main-scanning direction.

For example, Japanese Patent Application Laid-Open No. 7-234612 discusses a method for correcting the image misregistration. According to this method, each color of toner pattern is transferred from a corresponding one of a plurality of photosensitive members onto a transfer belt, relative positions of these toner patterns are detected by using optical sensors, and the image misregistration in the sub- and main-scanning directions is corrected based on the detection results. However, since the method discussed in Japanese Patent Application Laid-Open No. 7-234612 requires cleaning of the toner patterns formed on the transfer belt, down time is caused. Recently, for example, Japanese Patent Application Laid-Open No. 2012-032777 discusses an image forming apparatus capable of reducing such down time caused when the image misregistration is corrected. This image forming apparatus detects the image misregistration in the sub-scanning direction by using an electrostatic latent image pattern formed on a photosensitive member and corrects the image misregistration by using the detection results. When correcting the image misregistration in the sub-scanning direction, the image forming apparatus discussed in Japanese Patent Application Laid-Open No. 2012-032777 uses electrostatic latent image patterns without using toner patterns. Thus, an operation of cleaning toner patterns is not necessary. Therefore, the image forming apparatus is excellent in terms of reduction in down time and in reduction in consumption of toner.

However, as described above, the image misregistration may be caused not only in the sub-scanning direction but also in the main-scanning direction. If the image misregistration in the main-scanning direction is corrected by using toner patterns in a conventional manner, down time is caused.

SUMMARY OF THE INVENTION

The present invention is directed to an image forming apparatus capable of reducing down time and consumption of toner when correcting the image misregistration in the main-scanning direction.

According to an aspect of the present invention, an image forming apparatus includes a rotating photosensitive member, a light irradiation unit configured to form an electrostatic latent image on the photosensitive member by irradiating the photosensitive member with light, a detection unit configured to detect change of a surface potential of the photosensitive member, and a shielding unit configured to shield part of the light from the light irradiation unit. The light irradiation unit forms an electrostatic latent image pattern on the photosensitive member by irradiating the photosensitive member and the shielding unit with light. The detection unit detects, in a rotation direction of the photosensitive member, timing at which the surface potential changes depending on displacement of the electrostatic latent image pattern in an axial direction of the photosensitive member. The light irradiation from the light irradiation unit is controlled according to the detected timing.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

(Configuration of Image Forming Apparatus)

Figure 1:
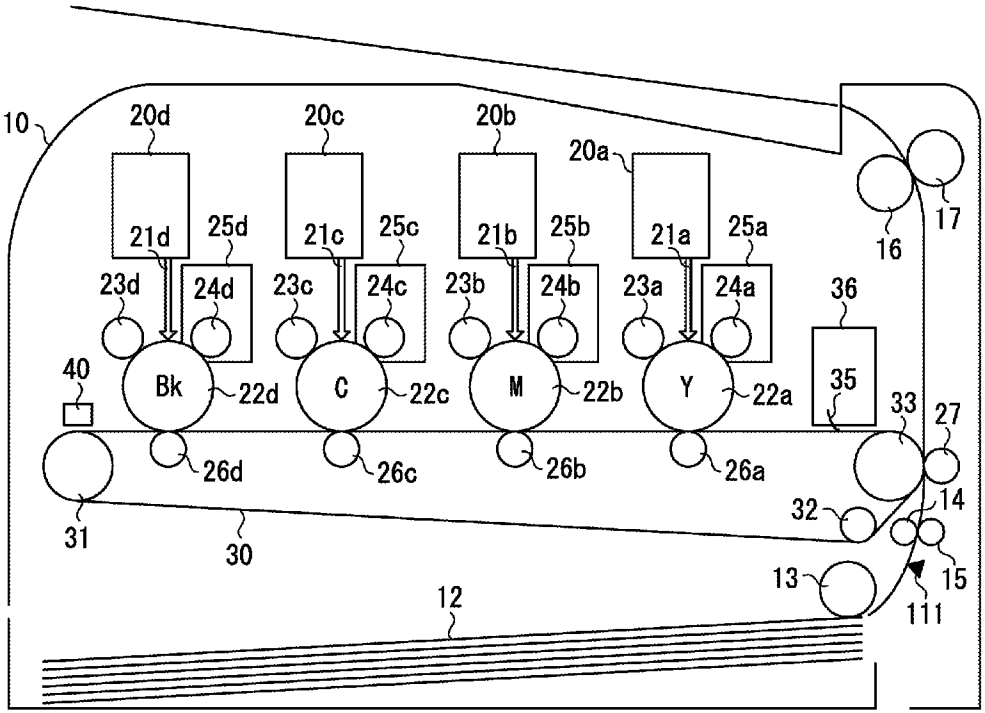
FIG. 1 illustrates a configuration of a tandem-system (4-drum system) image forming apparatus.

FIG. 1 illustrates a configuration of a color image forming apparatus 10 according to a first exemplary embodiment of the present invention. The color image forming apparatus in FIG. 1 includes four linearly-arranged photosensitive members for forming yellow, magenta, cyan, and black toner images. The color image forming apparatus is also called a tandem-system color image forming apparatus.

A pick-up roller 13 conveys a recording medium 12 such as a sheet, and a registration sensor 111 detects the top portion of the recording medium 12. Next, the recording medium 12 is temporarily stopped shortly after the top portion passes through a nip portion formed by a pair of conveyance rollers 14 and 15. Scanner units 20*a* to 20*d*, each of which serves as a light irradiation unit, include lenses, reflective mirrors, and laser diodes (light-emitting elements). In addition, these scanner units 20*a* to 20*d* sequentially irradiate photosensitive drums 22*a* to 22*d*, each of which serves as a rotating photosensitive member, with laser light 21*a* to 21*d*, respectively. Hereinafter, the direction in which the photosensitive drums 22*a* to 22*d* rotate is defined to be the sub-scanning direction and the direction in which the light from the scanner units 20*a* to 20*d* scan the respective photosensitive drums 22*a* to 22*d* is defined to be the main-scanning direction. The photosensitive drums 22*a* to 22*d* are previously charged by charging rollers 23*a* to 23*d*, respectively, before irradiated with the laser light. For example, a voltage of −1200 V is output to each of the charging rollers 23*a* to 23*d*, and a surface of each photosensitive drum is charged with a voltage of −700 V. If the photosensitive drums 22*a* to 22*d* at this charging potential are irradiated with the laser light 21*a* to 21*d* and electrostatic latent images are formed, the potential at these portions where the electrostatic latent images are formed is decreased to −100 V, for example. For example, developing devices 25*a* to 25*d* and developing rollers 24*a* to 24*d* output a voltage of −350 V. As a result, toner is attached to the electrostatic latent images on the photosensitive drums 22*a* to 22*d*, and toner images are formed on the photosensitive drums 22*a* to 22*d*. For example, primary transfer rollers 26*a* to 26*d* output a positive voltage of +1000 V, and the toner images on the photosensitive drums 22*a* to 22*d* are transferred onto an intermediate transfer belt 30 (a transfer member). In addition, each of the components (the charging rollers 23*a* to 23*d*, the developing devices 25*a* to 25*d*, and the primary transfer rollers 26*a* to 26*d*) that are arranged near the photosensitive drums 22*a* to 22*d* and that operate on the photosensitive drums 22*a* to 22*d* is also referred to as a process unit that acts on the photosensitive drums 22*a* to 22*d* for forming images. English letters a to d in the reference characters represent yellow, magenta, cyan, and black components and units, respectively. The developing devices 25*a* to 25*d* include the respective colors of toner and can form the respective colors of toner images on the respective photosensitive drums 22*a* to 22*d*.

Rollers 31 to 33 rotate the intermediate transfer belt 30 and convey the transferred toner image to a secondary transfer roller 27. Conveyance of the recording medium 12 is resumed so that the recording medium 12 is in synchronization with the conveyed toner image at the secondary transfer position of the secondary transfer roller 27. Next, the secondary transfer roller 27 transfers the toner image from the intermediate transfer belt 30 on the recording medium 12. Next, a pair of fixing rollers 16 and 17 heats and fixes the toner image on the recording medium 12 and outputs the recording medium 12 to the outside of the color image forming apparatus. A cleaning blade 35 collects toner that has not been transferred by the secondary transfer roller 27 from the intermediate transfer belt 30 to the recording medium 12 in a waste toner container 36. An operation of a color misregistration detection sensor 40 detecting toner patterns will be described below.

A light irradiation system using the scanner units 20*a* to 20*d* has been described with reference to FIG. 1. However, the present invention is not limited to such system. For example, in the case of an image forming apparatus including an LED array as a light irradiation unit, similar image misregistration may be caused. Thus, each of the following exemplary embodiments can be applied to such image forming apparatus. The following description will be made based on an example where the image forming apparatus includes scanner units as light irradiation units.

In addition, while in the above description the image forming apparatus includes the intermediate transfer belt 30, the present invention is applicable to image forming apparatuses having other systems. For example, the present invention is applicable to an image forming apparatus using a system in which a recording medium conveyance belt is included and a toner image developed on each photosensitive drum 22 is directly transferred onto a recording medium conveyed by the recording medium conveyance belt.

(Configuration of High-Voltage Power Supply Apparatus)

Figure 2A:
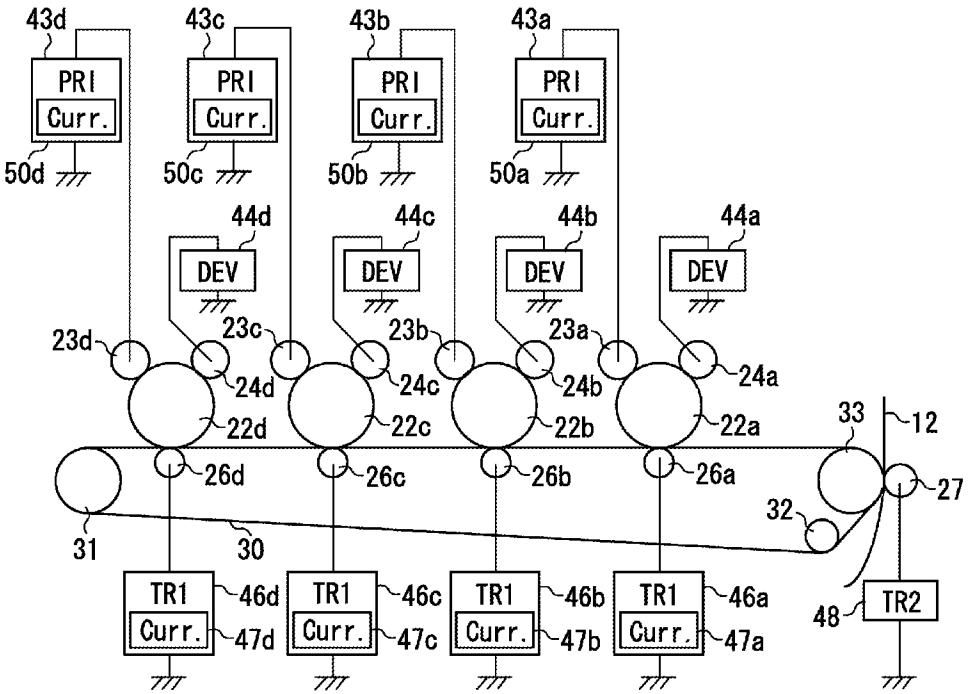
FIGS. 2A, 2B, and 2C illustrate a configuration of a high-voltage power supply apparatus, a circuit diagram of a charging high-voltage power supply, a hardware block diagram of an engine control unit, and a functional block diagram of the engine control unit.

Next, a configuration of a high-voltage power supply apparatus in the image forming apparatus in FIG. 1 will be described with reference to FIG. 2A. The high-voltage power supply apparatus illustrated in FIG. 2A includes charging high-voltage power supply circuits 43*a* to 43*d*, developing high-voltage power supply circuits 44*a* to 44*d*, primary transfer high-voltage power supply circuits 46*a* to 46*d*, and a secondary transfer high-voltage power supply circuit 48.

The charging high-voltage power supply circuits 43*a* to 43*d* apply voltages to the respective charging rollers 23*a* to 23*d* to form background potentials on surfaces of the respective photosensitive drums 22*a* to 22*d*. In this way, electrostatic latent images can be formed when laser light is radiated. The charging high-voltage power supply circuits 43*a* to 43*d* include current detection circuits 50*a* to 50*d*, respectively.

By applying voltages to the developing rollers 24*a* to 24*d*, the developing high-voltage power supply circuits 44*a* to 44*d* attach toner on the electrostatic latent images on the photosensitive drums 22*a* to 22*d* and form toner images, respectively.

By applying voltages to the primary transfer rollers 26*a* to 26*d*, the primary transfer high-voltage power supply circuits 46*a* to 46*d* transfer the toner images of the photosensitive drums 22*a* to 22*d* onto the intermediate transfer belt 30. By applying voltages to the secondary transfer roller 27, the secondary transfer high-voltage power supply circuit 48 transfers the toner image of the intermediate transfer belt 30 onto the recording medium 12.

(Circuit Diagram of High-Voltage Power Supply)

Figure 2B:
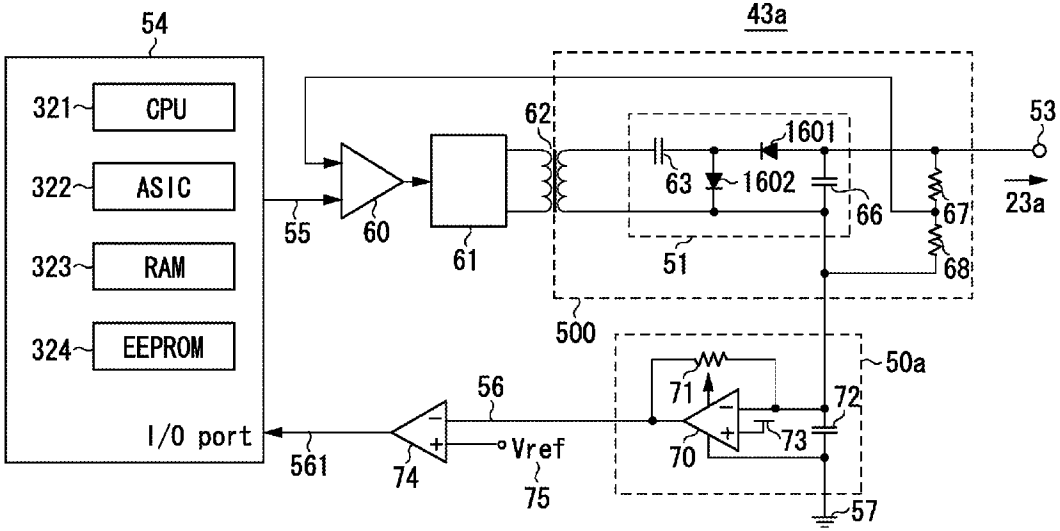

A circuit configuration of the charging high-voltage power supply circuit 43*a* in the high-voltage power supply apparatus in FIG. 2A will be described with reference to FIG. 2B. The charging high-voltage power supply circuits 43*b*, 43*c*, and 43*d* have the same circuit configuration. In FIG. 2B, a driving circuit 61 generates an alternating-current (AC) signal and a transformer 62 increases the amplitude of the voltage of the signal dozens of times. A rectification circuit 51 including diodes 1601 and 1602 and capacitors 63 and 66 rectifies and smoothes the increased AC signal. The rectified and smoothed voltage signal is next output to an output terminal 53 as a negative direct-current (DC) voltage. A comparator 60 controls output to the driving circuit 61 so that the voltage at the output terminal 53 divided by detection resistors 67 and 68 and a voltage value 55 set by an engine control unit 54 (which will simply be referred to as a control unit 54) are equal to each other. In addition, according to the voltage at the output terminal 53, a current flows from the ground to the output terminal 53 via the photosensitive drum 22*a* and the charging roller 23*a*.

In FIG. 2B, a current detection circuit 50*a* is inserted between a circuit 500 arranged on the secondary side of the transformer 62 and a ground point 57. In addition, the input terminals of an operational amplifier 70 have high impedance, and little current flows through these input terminals. Thus, most of the DC current flowing from the output terminal 53 to the ground point 57 via the circuit 500 arranged on the secondary side of the transformer 62 flows through a resistor 71. In addition, since the inverting input terminal of the operational amplifier 70 is connected to the output terminal via the resistor 71 (in a negative feedback arrangement), the inverting input terminal is virtually connected to a reference voltage 73 connected to the non-inverting input terminal. Thus, a detected voltage 56, which is proportional to the current amount flowing through the output terminal 53, appears at the output terminal of the operational amplifier 70. In other words, if the current flowing through the output terminal 53 changes, the detected voltage 56 at the output terminal of the operational amplifier 70 changes, not at the inverting input terminal of the operational amplifier 70. Namely, the current flowing through the resistor 71 changes. A capacitor 72 is arranged for stabilizing the inverting input terminal of the operational amplifier 70.

In addition, the detected voltage 56 indicating the detected current amount is input to the negative input terminal (inverting input terminal) of a comparator 74. A threshold Vref 75 is input to the positive input terminal of the comparator 74. When an input voltage at the inverting input terminal falls below the threshold, the output is set to Hi (positive), and a binarized voltage value 561 (Hi voltage) is input to the control unit 54. The threshold Vref 75 is set to be a value between a minimum value of the detected voltage 561 obtained when an electrostatic latent image for correcting image misregistration passes a position facing the process unit and a value of the detected voltage 561 before the electrostatic latent image passes the position. When an electrostatic latent image is detected, a rising edge and a falling edge of the detected voltage 561 are detected. For example, the control unit 54 uses an intermediate point between a rising detection timing and a falling detection timing of the detected voltage 561 as a detection position. Alternatively, the control unit 54 may detect either a rising or falling edge of the detected voltage 561.

(Hardware Block Diagram of Engine Control Unit 54)

Next, the control unit 54 will be described. The control unit 54 comprehensively controls operations of the image forming apparatus in FIG. 1. A central processing unit (CPU) 321 uses a random access memory (RAM) 323 as a main memory and a work area and controls the above engine mechanism unit according to various control programs stored in an electrically erasable/programmable read only memory (EEPROM) 324. In addition, for example, an application-specific integrated circuit (ASIC) 322 controls various motors and developing-bias high-voltage power supply control operations in various print sequences, according to instructions from the CPU 321. The ASIC 322 may be allowed to execute the functions of the CPU 321 partly or entirely. Alternatively, the CPU 321 may be allowed to execute the functions of the ASIC 322 partly or entirely. Other hardware corresponding to the control unit 54 may be allowed to execute the functions of the control unit 54 partly.

(Functional Block Diagram)

Figure 2C:
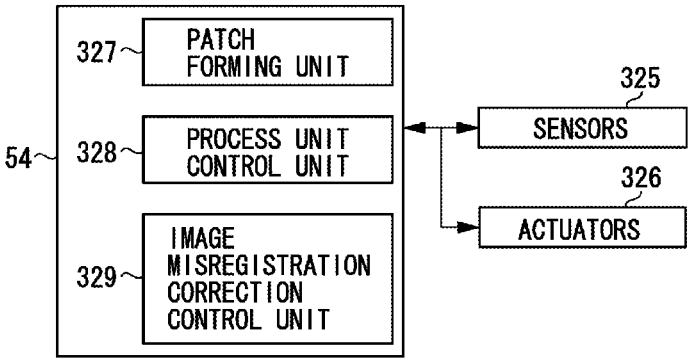

Next, the engine control unit 54 will be described with a functional block diagram in FIG. 2C. Actuators 326 and sensors 325 represent hardware. In addition, each of a patch forming unit 327, a process unit control unit 328, and an image misregistration correction control unit 329 represents a functional block. Next, each of these components will be described in detail.

The actuators 326 represent a group of actuators such as drive motors for the photosensitive drums 22*a* to 22*d* and separation motors for the developing devices 25*a* to 25*d*. The sensors 325 represent a group of sensors such as the registration sensor 111 and the current detection circuits 50*a* to 50*d*. The control unit 54 executes various types of processing, based on information acquired from these various types of sensors 325. For example, actuators 326 serve as driving sources for driving cams for separating the developing rollers 24*a* to 24*d* from the respective photosensitive drums 22*a* to 22*d*.

In addition, the patch forming unit 327 controls the scanner units 20*a* to 20*d* to form electrostatic latent image patterns 80 on the photosensitive drums 22*a* to 22*d*, respectively. From the timing detected by the detected voltage 561, the image misregistration correction control unit 329 calculates an image misregistration correction amount according to a calculation method which will be described below and corrects image misregistration.

Hardware for realizing the functions described above is not limited to the above examples. Any hardware such as the CPU 321, the ASIC 322, or other hardware may be operated. An arbitrary part of the processing may be allocated to any hardware.

(Configuration of Scanner Unit)

Figure 3A:
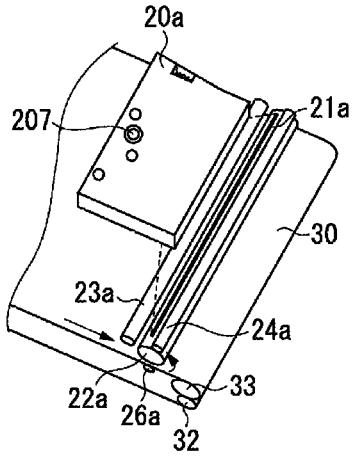
FIGS. 3A and 3B illustrate a configuration of a scanner unit.
Figure 3B:
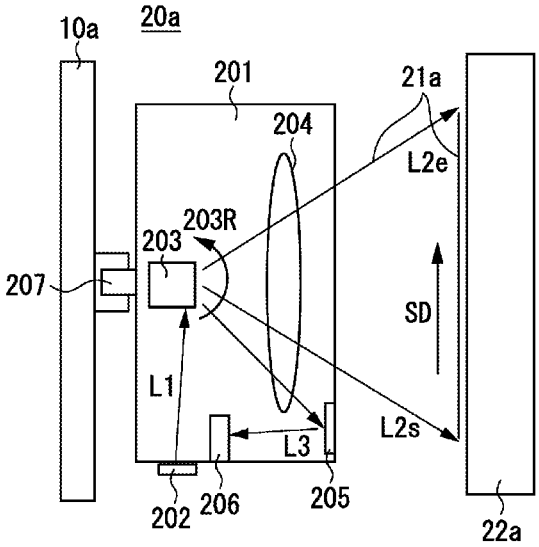

Next, a configuration of the scanner unit 20*a* in the image forming apparatus in FIG. 1 will be described with reference to FIGS. 3A and 3B. As illustrated in FIGS. 3A and 3B, an optical box 201 includes a light source 202, a polygonal mirror 203, a scanning lens 204, a write light reflection mirror 205, and a write start sensor 206.

The light source 202 emits a laser light flux L1 to the polygonal mirror 203. The polygonal mirror 203 is rotated by a scanner motor (not illustrated) in the direction of an arrow 203R and scans the photosensitive drum 22*a* with the laser light flux L1 in the direction of an arrow SD (laser light flux L2). This light flux L2 passes through the scanning lens 204 and forms an image on the photosensitive drum 22*a* outside the scanner unit 20*a*. When the photosensitive drum 22*a* is scanned in this way, an electrostatic latent image is formed on the photosensitive drum 22*a*.

Part (L3) of the scanning laser light flux is reflected by the reflection mirror 205 attached to the optical box 201 and is caused to be incident on the write start sensor 206. After the light flux L3 passes through the write start sensor 206, the image processing apparatus is halted for a certain write wait time. Next, the image processing apparatus reads a signal from an image controller (not illustrated) and starts driving the light source 202. In this way, the first pixel of each scanning line is not misregistered. In addition, in FIG. 3B, light fluxes L2s and L2e represent start and end points of the scanning line 21*a*, respectively.

The optical box 201 includes a positioning protrusion 207 that engages with a main body frame 10*a*. The scanner unit 20*a* is accurately positioned with respect to the main body frame 10*a*, that is, to the photosensitive drum 22*a*. Since the scanner units 20*a* to 20*d* maintain the respective accurate positions, image misregistration by installation errors of the scanner units is prevented.

(Description of Change of Write Start Position in Main-Scanning Direction)

Figure 4A:
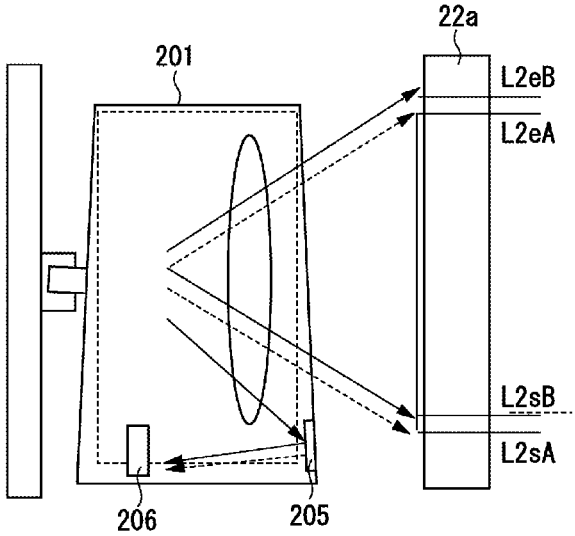
FIGS. 4A and 4B illustrate image misregistration in a main-scanning direction.
Figure 4B:
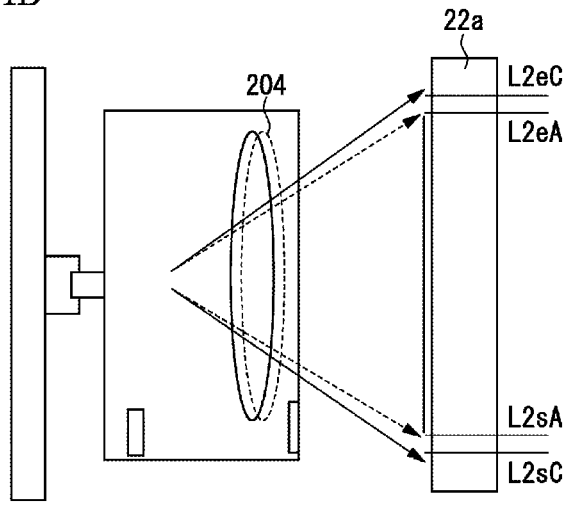

Even when the scanner units are accurately positioned with respect to the respective photosensitive drums, if the temperature inside the apparatus increases, image misregistration in the main-scanning direction is caused. Next, this phenomenon will be described in detail. FIGS. 4A and 4B illustrate image misregistration in the main-scanning direction caused by a temperature increase which is a primary cause. Before FIG. 4B, FIG. 4A will be described first.

If images are formed continuously over a long time, the temperature inside the apparatus is increased. As illustrated in FIG. 4A, before the temperature is increased, the optical box 201 has a shape indicated by a dashed line. However, if the optical box 201 expands to a shape indicated by a solid line, the angle of the reflection mirror 205 attached to the optical box 201 is changed. Consequently, the timing when the light L3 reaches the write start sensor 206 is changed, and start and end points L2sA and L2eA of the scanning line are also changed to positions L2sB and L2eB, respectively. This is called a change of the write start position in the main-scanning direction. If a temperature difference is caused among the scanner units 20*a* to 20*d*, the write start positions are changed, and image misregistration is caused, color misregistration is caused in the superimposed color image.

(Description of Electrostatic Latent Image Pattern Formed on Photosensitive Drum)

Figure 5A:
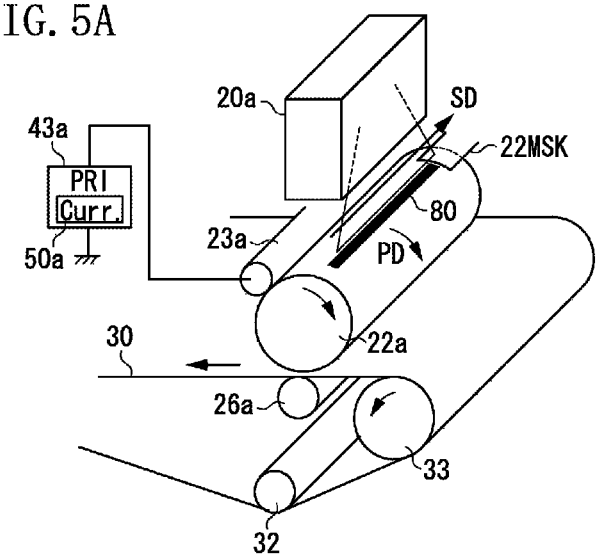
FIGS. 5A and 5B illustrate a configuration of a shielding unit according to a first exemplary embodiment.
Figure 5B:
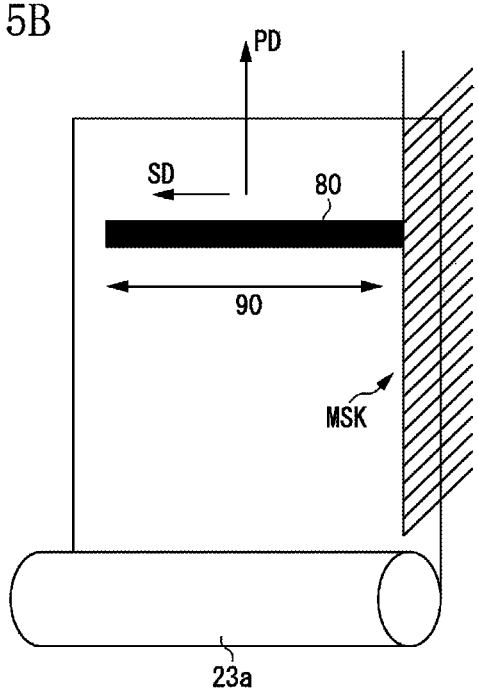

Next, an electrostatic latent image pattern for detecting change of the write position in the main-scanning direction will be described. A shielding unit, which is a feature of the present exemplary embodiment, is used to form an electrostatic latent image pattern on a photosensitive drum. Thus, first, the shielding unit will be described with reference to FIGS. 5A and 5B. For example, as illustrated in FIG. 5A, a light-shielding plate 22MSK, which is arranged near the surface of the photosensitive drum 22*a* and which has a linear end, can be used as the shielding unit. In FIG. 5A, the light-shielding plate 22MSK is set on the right end in the main-scanning direction (in the direction SD in FIG. 5A). However, the light-shielding plate 22MSK may be arranged on the left end. In addition, the light-shielding plate 22MSK is not necessarily fixed at an end in the main-scanning direction. The light-shielding plate 22MSK may be arranged to be movable so that, when an electrostatic latent image pattern is not formed (when a normal operation is executed), the light-shielding plate 22MSK is retracted from the image forming area. The light radiated from the scanner unit 20*a* scans the photosensitive drum 22*a* and forms an electrostatic latent image pattern 80 while being partially shielded by the light-shielding plate 22MSK. No electrostatic latent image is formed on the area on the photosensitive drum 22*a* where the light is shielded by the light-shielding plate 22MSK. Namely, as illustrated in FIG. 5B, the electrostatic latent image pattern 80 has a linear end in the main-scanning direction. In FIG. 5B, for convenience, the surface on the photosensitive drum 22*a* is illustrated by a rectangular frame. In the present exemplary embodiment, an image width 90 used for forming an normal image is set to be equal to or less than the length of the portion where an electrostatic latent image can be formed in the area not covered by the light-shielding plate 22MSK.

(Description of Control of Correction of Change of Write Start Position in Main-Scanning Direction)

Figure 6A:
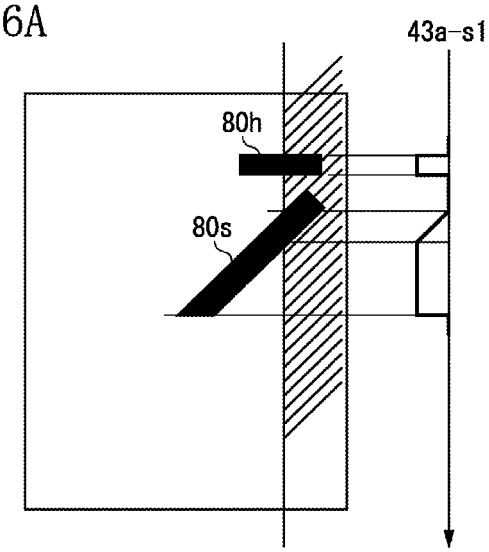
FIGS. 6A and 6B illustrate electrostatic latent image patterns that are formed according to the first exemplary embodiment.
Figure 6B:
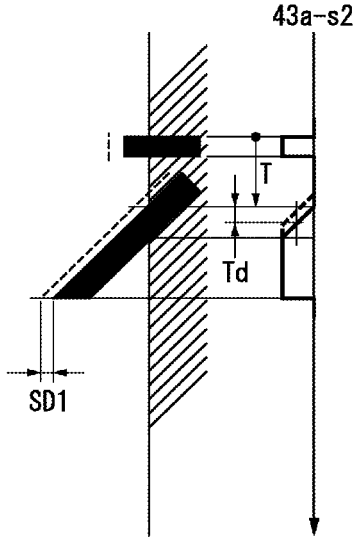

Next, a specific method for detecting change of the write start position in the main-scanning direction will be described with reference to FIGS. 6A and 6B. FIGS. 6A and 6B illustrate electrostatic latent image patterns 80*h* and 80*s* and a signal waveform of the voltage 561 detected by the charging high-voltage power supply circuit 43*a*. The electrostatic latent image patterns 80*h* and 80*s* are linear patterns parallel and diagonal to the main-scanning direction, respectively. As illustrated in FIG. 6A, when the electrostatic latent image patterns 80*h* and 80*s* are formed, the photosensitive drum 22*a* is exposed so that part of the light from the scanner unit 20*a* is shielded by the light-shielding plate 22MSK. As illustrated by a signal waveform 43*a*-s1, a voltage signal approximately proportional to the areas of the electrostatic latent image patterns is obtained.

Next, a situation where the write start position is changed by displacement SD1 after images are formed continuously over a long time and the temperature inside the apparatus is increased will be examined. Dashed lines in FIG. 6B represent the positions of the electrostatic latent image patterns 80*h* and 80*s* in a reference state in which little or no image misregistration is caused. Solid lines represent the positions of the electrostatic latent image patterns 80*h* and 80*s* in a state in which image misregistration is caused. A signal 43*a*-s2 in FIG. 6B shows that timing at which detection of the electrostatic latent image pattern 80*s* is started is displaced. More specifically, detection of the signal is displaced by time Td. This time Td is proportional to misregistration of the write start position displacement SD1 in the main-scanning direction. Thus, by detecting the time Td, the misregistration amount of the write start position can be detected.

The electrostatic latent image pattern 80*h* is used as a reference for accurately measuring the time Td. More specifically, a counter of a timer (not illustrated) is set to be started from a falling edge of a signal waveform of the electrostatic latent image pattern 80*h*. In addition, for example, an intermediate voltage between H and L levels is set as a threshold. After detection of the signal waveform of the electrostatic latent image pattern 80*s* is started, the minute that the value of the signal falls below the threshold, the counter is stopped. With such configuration, even if the laser light irradiation position is displaced in the sub-scanning direction, the misregistration amount of the write start position in the main-scanning direction can accurately be detected. While time T is observed between the electrostatic latent image patterns 80*h* and 80*s* in FIG. 6A, time T+Td is observed in the state in FIG. 6B. Based on this value Td, the image controller corrects timing of driving the light source 202. As a result, since the position at which an image is formed is shifted by displacement SD1 to the left in FIG. 6B, the same state as that in FIG. 6A is obtained. Thus, image misregistration caused by change of the write start position in the main-scanning direction can be prevented.

The shape of the formed electrostatic latent image pattern 80*s* is not limited to the shapes illustrated in FIGS. 6A and 6B. An arbitrary shape is applicable, as long as the voltage detection timing changes depending on displacement of the latent image pattern in the main-scanning direction.

(Flowchart of Control of Correction of Change of Write Start Position in Main-Scanning Direction)

Next, a specific procedure for executing the correction will be described with reference to flowcharts in FIGS. 7A and 7B.

Figure 7A:
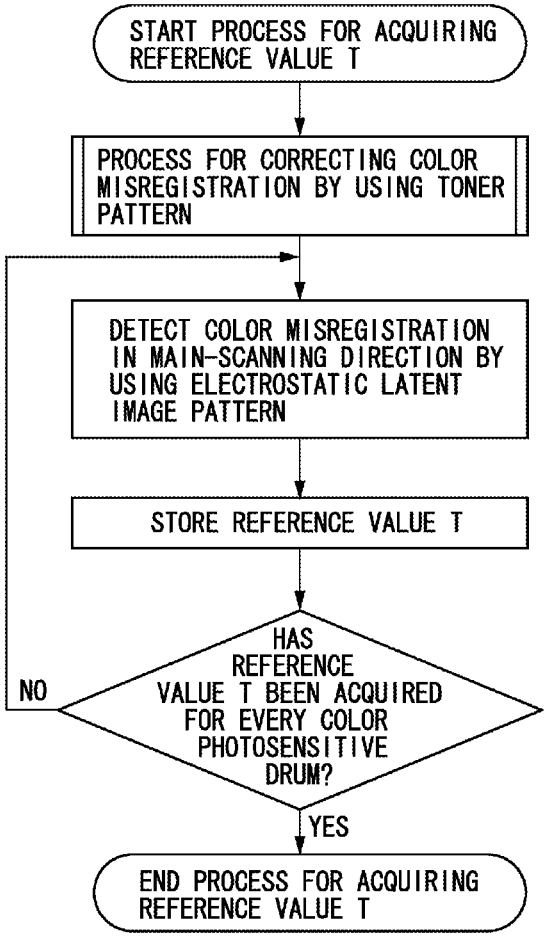
FIGS. 7A and 7B are flowcharts illustrating correction control according to the first exemplary embodiment.

First, a reference value is acquired as illustrated in FIG. 7A. The reference value corresponds to the above time T (FIG. 6B) and is a numerical value used as a reference for the correction. In an initial state in which the power source of the image forming apparatus is turned ON, color misregistration correction using toner patterns as in a conventional technique is executed to obtain a state in which color registration is sufficiently small. The color misregistration correction using toner pattern is executed to prevent an impact of color misregistration caused by other reasons than the above color misregistration caused by a temperature increase inside the apparatus. Examples of the other reasons include eccentricity of a photosensitive member or a gear for driving the photosensitive member. After executing the color misregistration correction, the electrostatic latent image patterns 80*h* and 80*s* are formed, and the reference value T is acquired by using a signal from the high-voltage power supply circuit 43*a*. The acquired reference value T is stored in a memory. The reference value T needs to be acquired per color.

Figure 7B:
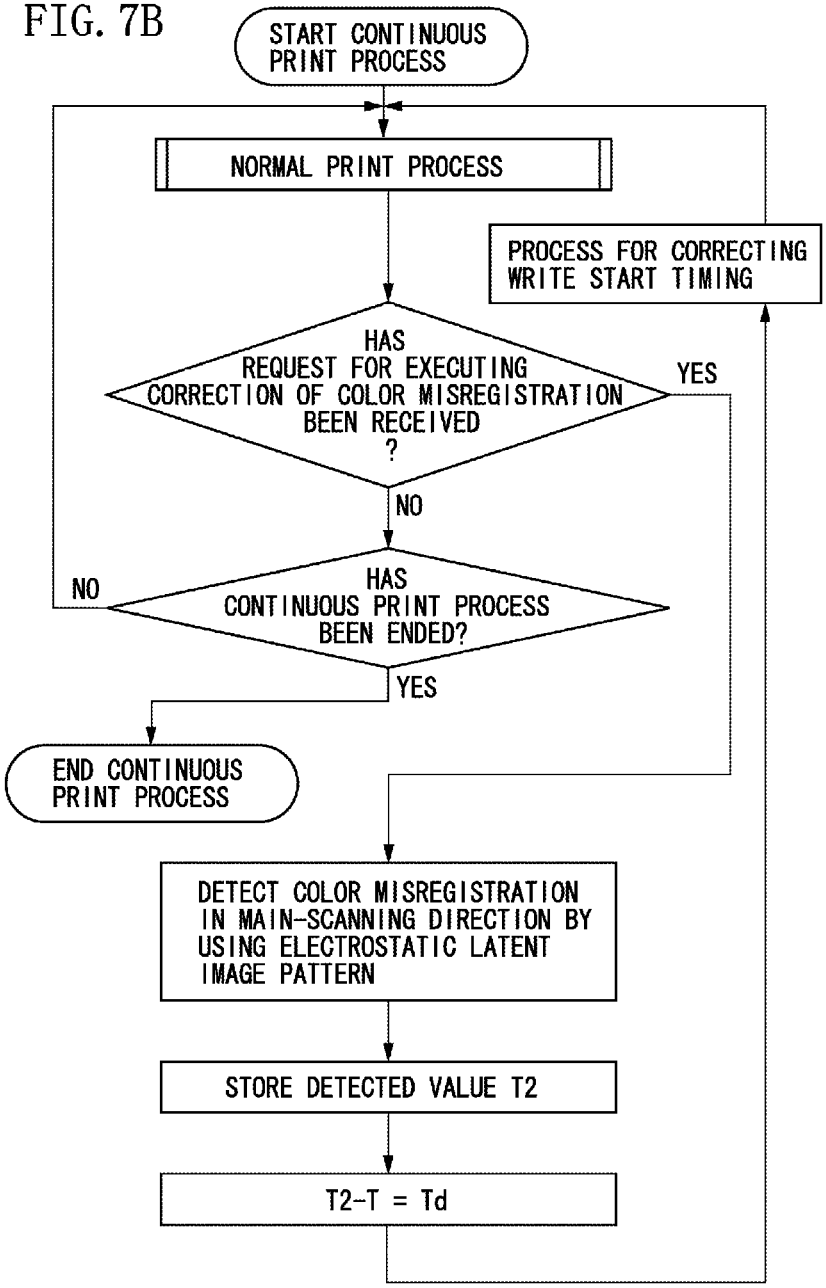

FIG. 7B illustrates a specific procedure for executing color misregistration correction control using electrostatic latent image patterns. In FIG. 7B, when receiving a request for executing color misregistration correction, the image forming apparatus according to the present exemplary embodiment starts a color misregistration correction process. For example, if the image forming apparatus receives a request for executing color misregistration correction during continuous printing of a plurality of sheets, the image forming apparatus starts a color misregistration process after the current sheet is printed. A condition for determining whether a request for executing color misregistration correction needs to be transmitted may be the temperature inside the apparatus detected by a temperature sensor inside the image forming apparatus or may be a count value of a print number counter. In any case, an operator can previously predict a state where color misregistration of the image forming apparatus in the main-scanning direction cannot be allowed, analyze the state, and determine a condition. When the number of continuously printed sheets is relatively small, the continuous printing operation is ended before this execution request is transmitted. However, when the number of continuously printed sheets is relatively large, this execution request is transmitted and the following process is executed. Namely, the image forming apparatus temporarily stops printing and detects electrostatic latent image patterns, again. Next, the image forming apparatus compares the result with the time T in the memory and determines the difference to be the time Td. Based on this time Td, the image forming apparatus corrects laser write start timing and resumes printing. By executing this image misregistration correction process per color, color misregistration can be prevented.

As described above, according to the present exemplary embodiment, since image misregistration in the main-scanning direction can be detected by using electrostatic latent image patterns, the write start position in the main-scanning direction can appropriately be corrected. Since no toner pattern is formed, an operation of cleaning a toner pattern is unnecessary. Thus, an image forming apparatus capable of reducing down time and consumption of toner can be provided.

In the first exemplary embodiment, when the write start position in the main-scanning direction is changed, the write start timing of the laser light radiated from a light irradiation unit is adjusted. In this way, the write start position can be corrected to the reference state. However, image misregistration in the main-scanning direction caused by an increase of the temperature in the apparatus is not limited to the above case. There are cases where the entire magnification in the main-scanning direction is changed. In a second exemplary embodiment of the present invention, a method for correcting the entire magnification to an appropriate magnification will be described.

(Description of Change of Entire Magnification in Main-Scanning Direction)

First, a reason why the entire magnification in the main-scanning direction is changed by an increase of the temperature inside the apparatus will be described.

If images are formed continuously over a long time, the temperature inside the apparatus is increased. As illustrated in FIG. 4B, the scanning lens 204, positioned indicated by the dashed line before the temperature is increased, is changed to the position indicated by the solid line. Consequently, the length of the scanning line extends. In this way, the start and end points L2sA and L2eA of the scanning line are also changed to positions L2sC and L2eC, respectively. This is called change of the entire magnification in the main-scanning direction. When the entire magnification is changed, a temperature difference is caused among the scanner units 20*a* to 20*d*. If the start and end points of the scanning lines of all the colors do not match, color misregistration is caused in the superimposed color image.

(Description of Electrostatic Latent Image Pattern Formed on Photosensitive Drum)

Figure 8A:
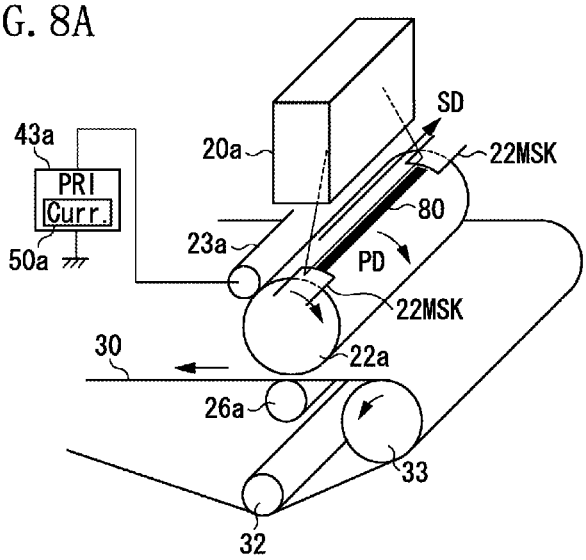
FIGS. 8A and 8B illustrate a configuration of a shielding unit according to a second exemplary embodiment.
Figure 8B:
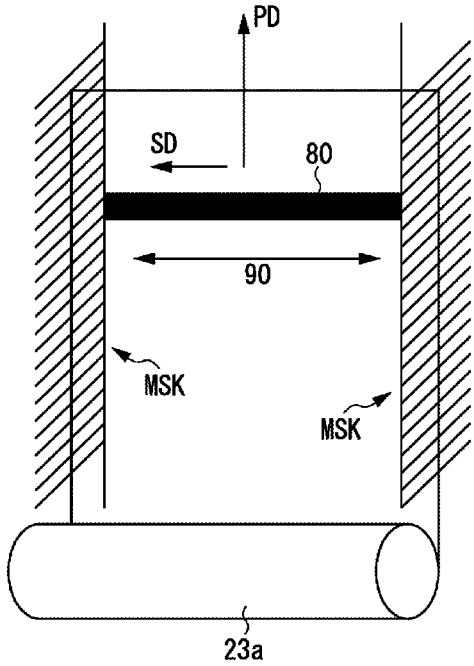

Next, an electrostatic latent image pattern for detecting change of the entire magnification in the main-scanning direction will be described. As in the first exemplary embodiment, a shielding unit is used to form an electrostatic latent image pattern on a photosensitive drum. FIG. 8A illustrates a configuration of a shielding unit. The same components as those in the first exemplary embodiment are denoted by the same reference characters, and redundant description thereof will be avoided. The present exemplary embodiment is different from the first exemplary embodiment in that a light-shielding plate 22MSK serving as a shielding unit is arranged at both ends in the main-scanning direction. In addition, the light-shielding plates 22MSK are not necessarily fixed at both ends in the main-scanning direction. The light-shielding plates 22MSK may be arranged to be movable so that, when an electrostatic latent image pattern is not formed (when a normal operation is executed), the light-shielding plates 22MSK are retracted from the image forming area. The light radiated from the scanner unit 20*a* scans the photosensitive drum 22*a* and forms an electrostatic latent image pattern 80 while being partially shielded by the light-shielding plates 22MSK. No electrostatic latent image is formed on the area on the photosensitive drum 22*a* where the light is shielded by the light-shielding plates 22MSK. Namely, as illustrated in FIG. 8B, the electrostatic latent image pattern 80 has linear ends in the main-scanning direction.

(Description of Control of Correction of Change of Entire Magnification in Main-Scanning Direction)

Figure 9A:
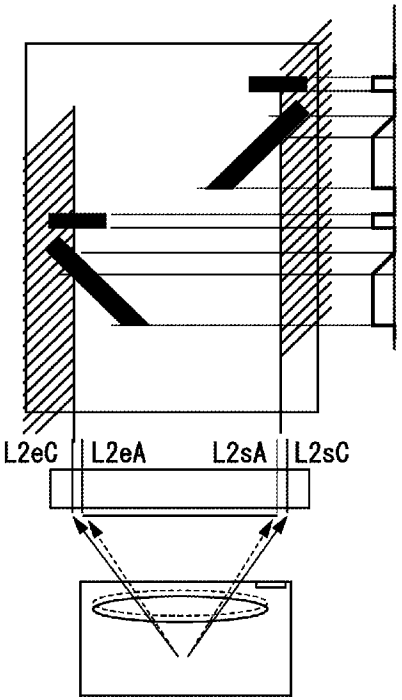
FIGS. 9A and 9B illustrate electrostatic latent image patterns that are formed according to the second exemplary embodiment.

Next, a specific method for detecting change of the entire magnification in the main-scanning direction will be described with reference to FIGS. 9A and 9B. In the present exemplary embodiment, as illustrated in FIG. 9A, a pair of electrostatic latent image patterns used in the first exemplary embodiment is formed at both ends in the main-scanning direction. By detecting the misregistration in the main-scanning direction at both ends as illustrated in FIG. 9A, change of the start and end points of the scanning line can be detected.

Figure 9B:
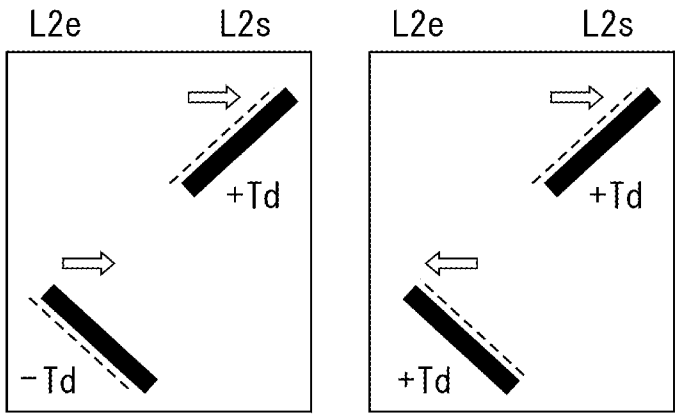

A table illustrated in FIG. 9B represents how the scanning line is changed in directions of misregistration detected at both ends. As illustrated in the table, change of the scanning line can basically be represented by a combination of expansion/contraction (change of the entire magnification) and misregistration to the right/left side (change of the write start position). The write start position is corrected by adjusting the laser light irradiation timing as described in the first exemplary embodiment. The entire magnification is corrected by adjusting the image clock frequency. In addition, in reality, since the misregistration amount is different between the right and left sides, expansion and contraction of the scanning line and misregistration to the right and left sides are mixed. In such case, both the image clock frequency and the laser light irradiation timing can be adjusted.

(Flowchart of Control of Correction of Change of Entire Magnification in Main-Scanning Direction)

Figure 10A:
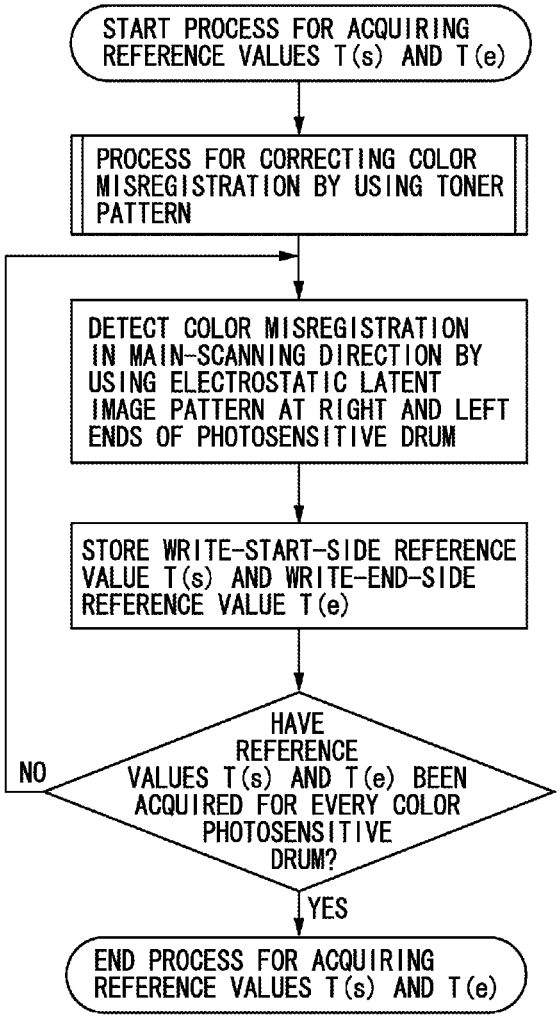
FIGS. 10A and 10B are flowcharts illustrating correction control according to the second exemplary embodiment.
Figure 10B:
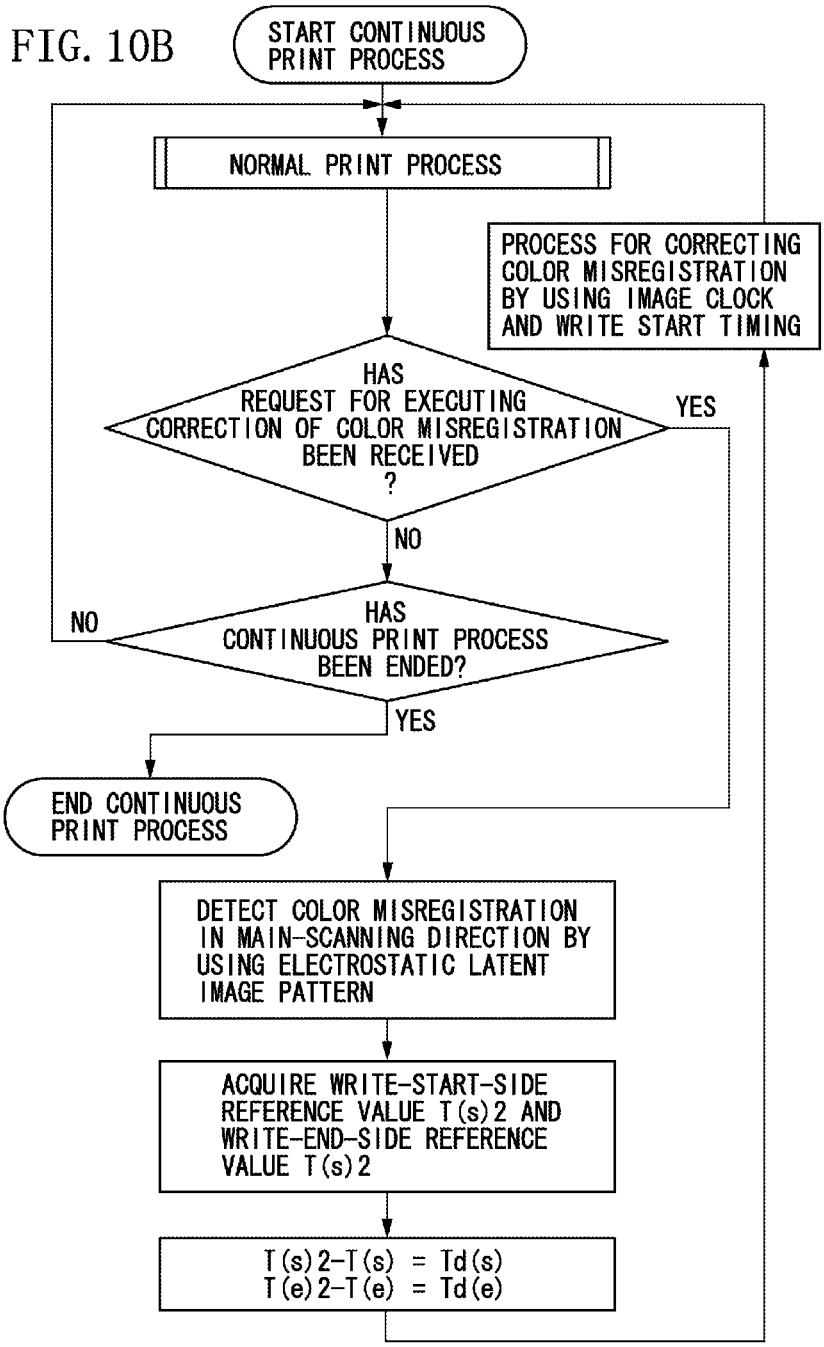

Next, a specific procedure for executing correction will be described with reference to flowcharts in FIGS. 10A and 10B. In FIGS. 10A and 10B, description of the same portions as those in the first exemplary embodiment will be avoided. First, in FIG. 10A, a reference value is acquired for each of the electrostatic latent image patterns at both ends. Before the reference values are acquired, as in the first exemplary embodiment, color misregistration is corrected by using toner patterns to obtain a state in which color registration is sufficiently small. After the color misregistration correction, reference values are acquired by forming electrostatic latent image patterns at both ends of a photosensitive member in the main-scanning direction. The image forming apparatus acquires reference values T(s) and T(e) of the electrostatic latent image patterns located on the write start and end sides of the scanning line, respectively. These two reference values acquired are stored in a memory. The reference values need to be acquired per color.

FIG. 10B illustrates a specific procedure for executing color misregistration correction control by using electrostatic latent image patterns. In FIG. 10B, when receiving a request for executing color misregistration correction, the image forming apparatus according to the present exemplary embodiment starts a color misregistration correction process. As in the acquisition of the reference values, electrostatic latent image patterns are formed at both ends and detection is executed. The result is compared with the reference values T(s) and T(e) in the memory and differences Td(s) and Td(e) are determined. While referring to these differences and the table illustrated in FIG. 9B, the image forming apparatus adjusts the image clock frequency and the laser light write start timing and resumes printing. The image forming apparatus prevents the color misregistration by executing this image misregistration correction process per color.

As described above, according to the present exemplary embodiment, by detecting the image misregistration in the main-scanning direction by using electrostatic latent image patterns, the entire magnification in the main-scanning direction can be corrected to an appropriate magnification. Since no toner pattern is formed, an operation of cleaning a toner pattern is unnecessary. Thus, an image forming apparatus capable of reducing down time and consumption of toner can be provided.

In the first and second exemplary embodiments, the two electrostatic latent image patterns (80*h* and 80*s*) illustrated in FIG. 6A are formed on a photosensitive member so that, even when the laser light irradiation position is shifted in the sub-scanning direction, the misregistration amount in the main-scanning direction can accurately be detected. In a third exemplary embodiment of the present invention, a method for detecting the image misregistration amount in the main-scanning direction by using a single electrostatic latent image pattern will be described.

(Description of Electrostatic Latent Image Pattern Formed on Photosensitive Drum)

Figure 11A:
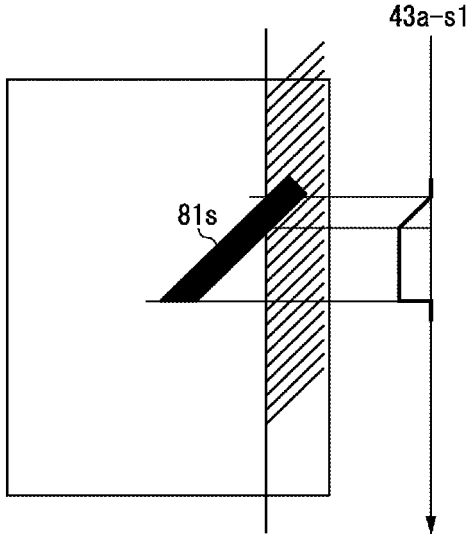
FIGS. 11A and 11B illustrate an electrostatic latent image pattern formed according to a third exemplary embodiment.
Figure 11B:
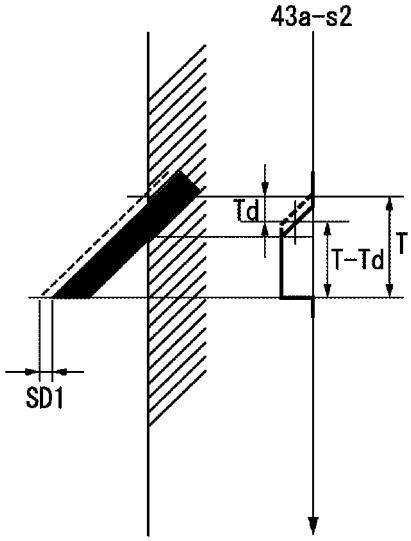

FIGS. 11A and 11B illustrate the shape of an electrostatic latent image pattern according to the present exemplary embodiment. Unlike the first and second exemplary embodiments, in the present exemplary embodiment, only a single electrostatic latent image pattern (81*s*) is formed. By measuring time from when detection of the electrostatic latent image pattern 81*s* is started to when the detection is ended, the image misregistration amount in the main-scanning direction can be detected. When the detection is executed, an appropriate threshold as described in the first exemplary embodiment may be set. In this way, the moment that the above value falls below the threshold, a counter is started, and the moment that the value exceeds the threshold, the counter is stopped. With this method, too, even when the laser light is shifted in the sub-scanning direction, the image misregistration amount in the main-scanning direction can accurately be detected. If it is clear that the laser light is not shifted in the sub-scanning direction, for example, if a process for correcting the image misregistration in the sub-scanning direction has already been executed as pre-processing, time from when a latent image is formed to when the electrostatic latent image pattern 81*s* is detected may be measured. In this way, too, the image misregistration amount in the main-scanning direction can be detected.

The electrostatic latent image pattern 81*s* formed in the present exemplary embodiment is not limited to the shapes illustrated in FIGS. 11A and 11B. The electrostatic latent image pattern 81*s* may have an arbitrary shape, as long as the voltage detection timing changes depending on displacement of the electrostatic latent image pattern in the main-scanning direction.

As described above, according to the present exemplary embodiment, the image misregistration in the main-scanning direction can be corrected by using a single electrostatic latent image pattern. Thus, according to the present exemplary embodiment, too, as in the above exemplary embodiments, an image forming apparatus capable of reducing down time and consumption of toner can be provided.

In the above exemplary embodiments, a shielding unit for detecting the image misregistration amount in the main-scanning direction is used, part of the laser light is shielded by this shielding unit, and at least one electrostatic latent image pattern is formed on a photosensitive drum. However, the method for forming electrostatic latent image patterns is not limited to the above examples. In a fourth exemplary embodiment of the present invention, the same electrostatic latent image pattern as that of the above exemplary embodiments is formed without arranging a shielding unit.

Figure 12A:
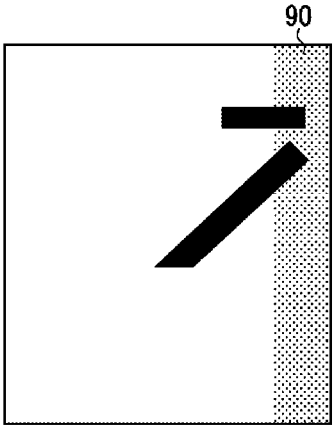
FIGS. 12A and 12B illustrate a configuration according to a fourth exemplary embodiment.

FIG. 12A illustrates a state in which electrostatic latent image patterns are formed on a photosensitive drum by radiating light to an area additionally including an area 90 that is arranged at an end of the photosensitive drum and that is not coated with a photosensitive layer. No electrostatic latent image is formed in the area 90 that is not coated with a photosensitive layer. Thus, with this configuration, the same electrostatic latent image patterns as those obtained when part of the laser light is shielded can be formed.

Figure 12B:
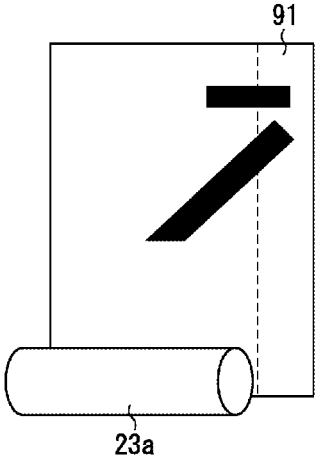

FIG. 12B illustrates a state in which electrostatic latent image patterns are formed on a photosensitive drum by radiating light to an area additionally including an area 91 in which the charging roller 23*a* (detection unit) cannot detect change of a surface potential of the photosensitive drum. Since the charging roller 23*a* does not reach the area 91, even if electrostatic latent images are formed in this area 91, change of the surface potential cannot be detected. Namely, the charging roller 23*a* assumes that no electrostatic latent image is formed in this area. Thus, with this configuration, the same electrostatic latent image patterns as those obtained where part of the laser light is shielded can be formed.

As described above, according to the present exemplary embodiment, the image misregistration amount in the main-scanning direction can be detected by using electrostatic latent image patterns formed in the area that is not coated with a photosensitive layer or in the area where change of the surface potential cannot be detected, without arranging a shielding unit. Thus, in the present exemplary embodiment, too, as in the above exemplary embodiments, an image forming apparatus capable of reducing down time and consumption of toner can be provided. In addition, since no shielding unit is required, there is no need to ensure space for a shielding unit. As a result, the size of the apparatus is not increased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-186540 filed Aug. 27, 2012, which is hereby incorporated by reference herein in its entirety.

What is claimed is:

1. An image forming apparatus comprising:

a rotating photosensitive member;

a light irradiation unit configured to form an electrostatic latent image on the photosensitive member by irradiating the photosensitive member, which is charged, with light;

a detection unit configured to detect change of a surface potential of the photosensitive member; and a shielding unit configured to shield part of the light from the light irradiation unit, wherein the light irradiation unit forms an electrostatic latent image pattern on the photosensitive member by irradiating the photosensitive member and the shielding unit with light, wherein the detection unit detects, in a rotation direction of the photosensitive member, timing at which the surface potential changes depending on displacement of the electrostatic latent image pattern in an axial direction of the photosensitive member, and wherein the light irradiation from the light irradiation unit is controlled according to the detected timing.

2. The image forming apparatus according to claim 1, wherein the shielding unit is arranged between the light irradiation unit and the photosensitive member at an end of the photosensitive member in the axial direction.

3. The image forming apparatus according to claim 2, wherein the shielding unit is arranged at both ends of the photosensitive member in the axial direction.

4. The image forming apparatus according to claim 1, further comprising sets of the photosensitive member, the light irradiation unit, the detection unit, and the shielding unit, the sets corresponding to respective colors, wherein, by transferring color images formed on the respective photosensitive members on a recording medium or a transfer member, a color image is formed on the recording medium or the transfer member.

5. The image forming apparatus according to claim 1, wherein the electrostatic latent image pattern includes a first electrostatic latent image pattern having a linear shape parallel to the axial direction and a second electrostatic latent image pattern having a linear shape diagonal to the axial direction, and wherein the light irradiation from the light irradiation unit is controlled according to time from timing at which the surface potential is changed by the first electrostatic latent image pattern to timing at which the surface potential is changed by the second electrostatic latent image pattern.

6. The image forming apparatus according to claim 1, wherein the electrostatic latent image pattern includes an electrostatic latent image pattern having a linear shape diagonal to the axial direction, and wherein the light irradiation from the light irradiation unit is controlled according to time from timing at which the surface potential starts to be changed by the diagonal electrostatic latent image pattern to timing at which the change of the surface potential is ended.

7. The image forming apparatus according to claim 1, further comprising a storage unit configured to store a reference time regarding a state existing prior to change of the electrostatic latent image pattern in the axial direction, wherein the light irradiation from the light irradiation unit is controlled based on a difference between the reference timing stored in the storage unit and the detected timing.

8. The image forming apparatus according to claim 1, wherein control of the light irradiation signifies adjustment of timing at which the light irradiation unit irradiates the photosensitive member with light.

9. The image forming apparatus according to claim 1, further comprising:

a process unit configured to act on the photosensitive member; and a voltage application unit configured to apply a voltage to the process unit, wherein the detection unit detects an output corresponding to a current flowing between the process unit and the photosensitive member in response to the voltage application unit applying the voltage to the process unit.

10. The image forming apparatus according to claim 9, wherein the process unit includes a charging unit configured to charge the photosensitive member, a developing unit configured to develop the electrostatic latent image formed on the photosensitive member with toner to form a toner image on the photosensitive member, and a transfer unit configured to transfer the toner image formed on the photosensitive member onto a recording medium or an image bearing member.

11. An image forming apparatus comprising:

a rotating photosensitive member;

a light irradiation unit configured to form an electrostatic latent image on the photosensitive member by irradiating the photosensitive member, which is charged, with light; and a detection unit configured to detect change of a surface potential of the photosensitive member, wherein, by irradiating an area where a photosensitive layer of the photosensitive member is arranged and an area where the photosensitive layer is not arranged with light, the light irradiation unit forms an electrostatic latent image pattern on the area where the photosensitive layer is arranged, wherein the detection unit detects, in a rotation direction of the photosensitive member, timing at which the surface potential changes depending on displacement of the electrostatic latent image pattern in an axial direction of the photosensitive member, and wherein the light irradiation from the light irradiation unit is controlled according to the detected timing.

12. The image forming apparatus according to claim 11, wherein the area where the photosensitive layer is not arranged exists at an end of the photosensitive member in the axial direction.

13. The image forming apparatus according to claim 12, wherein the area where the photosensitive layer is not arranged exists at both ends of the photosensitive member in the axial direction.

14. The image forming apparatus according to claim 12, further comprising sets of the photosensitive member, the light irradiation unit, the detection unit, and the shielding unit, the sets corresponding to respective colors, wherein, by transferring color images formed on the respective photosensitive members on a recording medium or a transfer member, a color image is formed on the recording medium or the transfer member.

15. An image forming apparatus comprising:

a rotating photosensitive member;

a light irradiation unit configured to form an electrostatic latent image on the photosensitive member by irradiating the photosensitive member, which is charged, with light; and a detection unit configured to detect change of a surface potential of the photosensitive member, wherein, by irradiating an area where change of a surface potential of the photosensitive member is detectable by the detection unit and an area where the change is undetectable by the detection unit with light, the light irradiation unit forms an electrostatic latent image pattern on the photosensitive member, wherein the detection unit detects, in a rotation direction of the photosensitive member, timing at which the surface potential changes depending on displacement of the electrostatic latent image pattern in an axial direction of the photosensitive member, and wherein the light irradiation from the light irradiation unit is controlled according to the detected timing.

16. The image forming apparatus according to claim 15, wherein the detection unit has a length, in the axial direction, corresponding to the area where change of the surface potential is detectable by the detection unit, and an end of the detection unit exists on an inner side of an end of the photosensitive member.

17. The image forming apparatus according to claim 16, wherein the length of the detection unit in the axial direction is shorter than that of the photosensitive member.

18. The image forming apparatus according to claim 15, further comprising sets of the photosensitive member, the light irradiation unit, and the detection unit, the sets corresponding to respective colors, wherein, by transferring color images formed on the respective photosensitive members on a recording medium or a transfer member, a color image is formed on the recording medium or the transfer member.

* * * * *